US005601221A

United States Patent [19]

Karr

[11] Patent Number: 5,601,221

[45] Date of Patent: Feb. 11, 1997

[54] INSULATED BEVERAGE POUCH SYSTEM

[76] Inventor: Joseph M. Karr, 908 Chaumont Ave., Dauphin Island, Ala. 36528

[21] Appl. No.: 597,565

[22] Filed: Feb. 2, 1996

[51] Int. Cl.[6] ..... A45F 5/00

[52] U.S. Cl. ..... 224/148.2; 224/148.4; 24/30.5 R; 24/543; 24/461; 222/175; 383/68

[58] Field of Search ..... 224/148.1–148.7, 224/627, 628, 629; 222/175, 105, 92, 107; 383/63, 68, 69, 88, 89, 901, 906; 24/460, 461, 30.5 R, 30.5 P, 30.5 S, 543; D9/434, 435, 443; 604/335, 408

[56] References Cited

U.S. PATENT DOCUMENTS

| | | | |
|---|---|---|---|
| 3,978,555 | 9/1976 | Weisenthal | 24/543 |
| 4,420,097 | 12/1983 | Motsenbocker | 224/148.7 |
| 4,551,888 | 11/1985 | Beecher | 24/30.5 P |
| 4,754,903 | 7/1988 | Dennis | 224/148 |
| 4,948,023 | 8/1990 | Tripp | 224/148.2 |
| 4,960,521 | 10/1990 | Keller | 24/543 |
| 5,085,349 | 2/1992 | Fawcett | 224/148.2 |
| 5,104,016 | 4/1992 | Runkel | 224/148 |
| 5,261,554 | 11/1993 | Forbes | 220/412 |
| 5,282,557 | 2/1994 | McCook | 224/148 |
| 5,400,934 | 3/1995 | Ducros | 224/148.2 |

*Primary Examiner*—Renee S. Luebke
*Assistant Examiner*—Gregory M. Vidvich
*Attorney, Agent, or Firm*—Joseph N. Breaux

[57] ABSTRACT

An insulated beverage pouch system that includes an inner beverage pouch and an outer insulated carrying bag into which the inner beverage pouch is placed. The beverage pouch-is sealable with a clip mechanism having parallel clamping ridges.

15 Claims, 2 Drawing Sheets

INSULATED BEVERAGE POUCH SYSTEM

TECHNICAL FIELD

The present invention relates to insulated container systems used for transporting and storing beverages for consumption at a remote location and more particularly to insulated container systems used for transporting and storing beverages for consumption at a remote location that include a sealable inner pouch member that is positioned within an insulated carrying bag during use.

BACKGROUND ART

It is often desirable to have a convenient, easy to carry, beverage container for transporting beverages to remote locations for consumption. Because the beverage may be consumed many hours after being placed within the container, it would be a benefit to have a transporting and storage container that had an insulating quality to assist in maintaining hot beverages as hot as possible and cold beverages as cold as possible during the period before consumption thereof. It would also be a benefit to have a beverage transportation and storage system that included an inner container and an outer insulated carrying bag into which the beverage container could be placed. In addition, because it is often desirable to place frozen liquids such as ice into the container to assist in maintaining the beverage at a desirable temperature, it would be a benefit if the container included a large mouth opening to allow multiple cubes of ice to be inserted into the container without requiring crushing.

GENERAL SUMMARY DISCUSSION OF INVENTION

It is thus an object of the invention to provide an insulated beverage pouch system that includes an inner beverage container and an outer insulated carrying bag into which the inner beverage container is placed.

It is a further object of the invention to provide an insulated beverage pouch system that includes a beverage container having a mouth opening of sufficient size to allow simultaneous insertion therethrough of multiple ice cubes.

it is a still further object of the invention to provide an insulated beverage pouch system that accomplishes both of the above objects in combination.

Accordingly, an insulated beverage pouch system is provided. The pouch system comprises an insulated outer carrying bag having a pouch compartment formed therein that is accessible through a sealable compartment access flap, the carrying bag having at least one strap member positionable over the shoulder of a user in a manner to allow a user to carry the carrying bag in a hands free manner; a flexible, inner beverage pouch of a size sufficient to allow the inner beverage pouch to be completely disposed within the pouch compartment with the compartment access flap sealed, the inner beverage pouch having a beverage cavity formed therein, an access opening into the beverage cavity at one end thereof, a bottom cavity portion formed at an opposite end thereof, and a draw tube having a first end in fluid communication with the bottom cavity portion of the beverage cavity; and a clip mechanism having a first and second pivotally connected clip portion, the first clip portion having two, first-clamping ridges oriented in parallel that extend upwardly from a first planar surface thereof, a first end pivotally attached to the second clip portion, and a second end having a first securing mechanism portion of an interlocking clip securing mechanism attached thereto, the second clip portion having three, second-clamping ridges oriented in parallel to each other that extend upwardly from a second planar surface thereof, a third end pivotally attached to the first end of the first clip portion, and a fourth end having a second securing mechanism portion of the interlocking clip securing mechanism attached thereto, the first-clamping ridges being spaced and located on the first clip portion and the second-clamping ridges being spaced and located on the second clip portion in a manner such that when the first and second clip portions are pivoted in a first direction the two first-clamping ridges have a second-clamping ridge disposed therebetween and the first and second securing mechanism portions of the interlocking clip securing mechanism are securable together to lock the first and second clip portions in a substantially fixed position with respect to each other, a section of the inner pouch between the bottom cavity portion and the access opening being positionable between the first and second clip portions in a manner to provide a liquid tight barrier between the bottom cavity portion and the access opening when the first and second clip portions are locked in a substantially fixed position with respect to each other with the interlocking clip securing mechanism.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
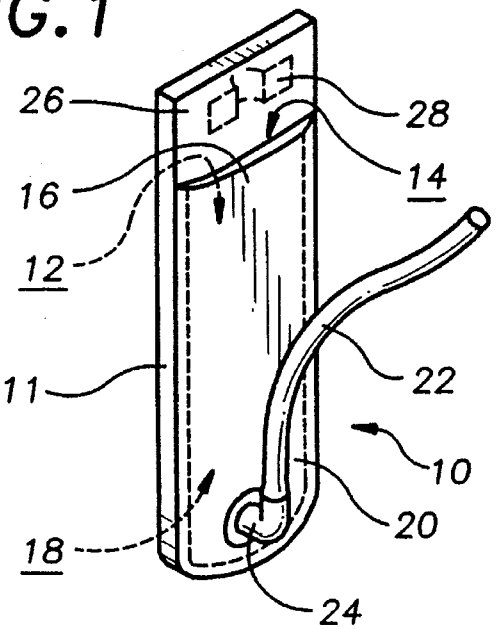
FIG. 1 is a perspective view of an exemplary embodiment of the flexible, inner pouch of the insulated beverage pouch system of the present invention including a preferred sealing flap and draw tube securing tab.

As discussed herein before, the insulated beverage pouch system of the present invention comprises a flexible, inner pouch; a clip mechanism; and an outer carrying bag. FIG. 1 shows an exemplary embodiment of the flexible, inner pouch, generally designated by the numeral 10. Inner pouch 10 is constructed from a section of resilient, flexible plastic sheeting material that has been seam welded along the outer perimeter 11 thereof to form a beverage cavity 12. Inner pouch 10 also includes an access opening 14 in connection with beverage cavity 12 at one end 16 thereof, a bottom cavity portion 18 formed at an opposite end 20 thereof, and a draw tube 22 having a first end 24 in fluid communication with bottom cavity portion 18. In this embodiment, inner pouch 10 also includes a sealing flap 26 and a woven nylon, draw tube securing tab 28. Draw tube securing tab 28 has one free end releasably securable about draw tube 22 with a section of hook and pile type fastener.

Figure 2:
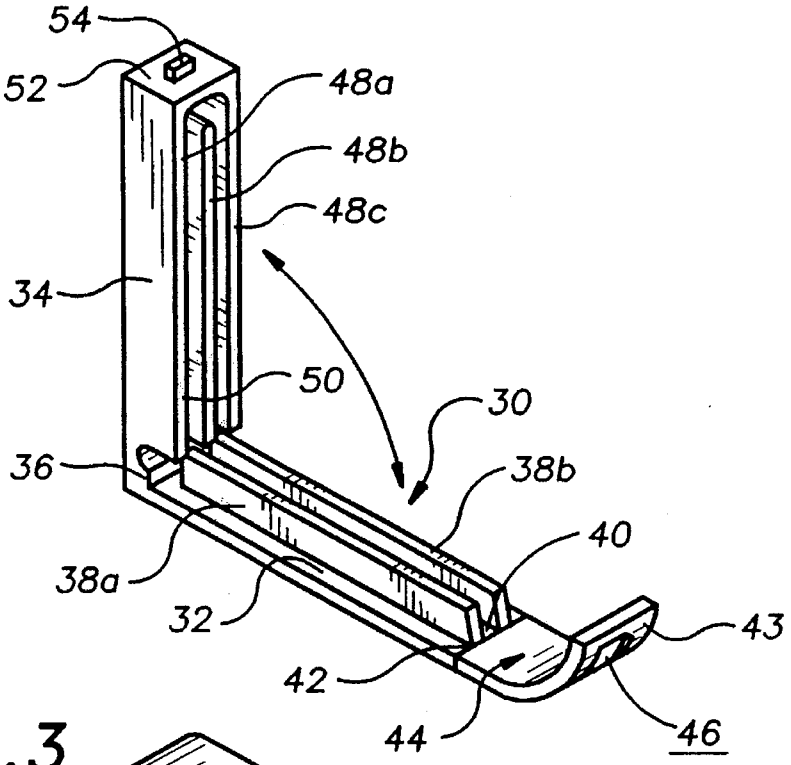
FIG. 2 is a perspective view of an exemplary embodiment of the clip mechanism of the insulated beverage pouch system of the present invention with the first and second clip portions pivoted out of engagement and the first and second securing mechanism portions of the interlocking clip securing mechanism disengaged.

FIG. 2 is a perspective view of an exemplary embodiment of the clip mechanism of the insulated beverage pouch system, generally designated by the numeral 30. Clip mechanism 30 is integrally molded from plastic and includes a first clip portion 32 and a second clip portion 34. First and second clip portions 32,34 are pivotally connected with a flexible pivot section 36. First clip portion 32 has two, first-clamping ridges 38*a*,38*b* that are oriented in parallel and that extend upwardly from a first planar surface 40. A second end 42 of first clip portion 32 has a first securing mechanism portion 43 of an interlocking clip securing mechanism, generally referenced by the numeral 44, attached thereto. In this embodiment, first securing mechanism portion 43 has a securing aperture 46 formed therethrough.

Second clip portion 34 has three, second-clamping ridges 48*a*, 48*b*, 48*c* that are oriented in parallel to each other and that extend upwardly from a second planar surface 50. A forward end 52 has a second securing mechanism portion 54 of interlocking clip securing mechanism 44 formed thereon. In this embodiment, second securing mechanism portion 54 is a protrusion having dimensions selected to allow second securing mechanism portion 54 to be deformably inserted into and frictionally retained within securing aperture 46.

First-clamping ridges 38*a*, 38*b* are spaced and located on first clip portion 32 and second-clamping ridges 48*a*, 48*b*, 48*c* are spaced and located on second clip portion 34 in a manner such that when the first and second clip portions 32, 34 are pivoted in a first direction toward one another, the two first-clamping ridges 38*a*, 38*b* have second-clamping ridge 48*b* disposed therebetween. When first and second clip portions 32, 34 are pivoted together as described, there is a gap between the first-clamping ridges 38*a*, 38*b* and the second-clamping ridges 48*a*, 48*b*, 48*c* of sufficient size to allow a section of inner pouch 10 that is located between bottom cavity portion 18 and access opening 12 to be compressibly disposed within the gap in a manner to provide a liquid tight barrier between bottom cavity portion 18 and access opening 12 when first and second clip portions 32, 34 are locked with interlocking clip securing mechanism 44.

Figure 3:
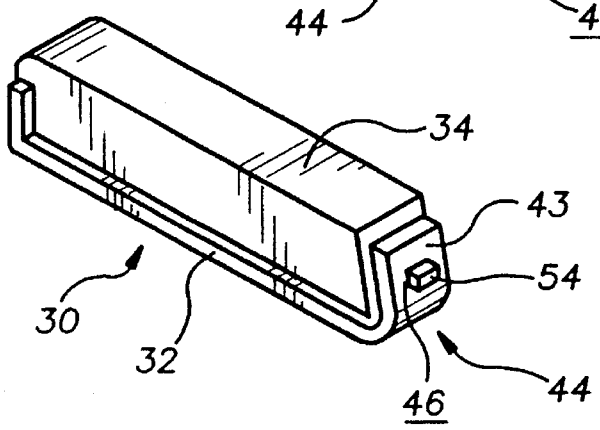
FIG. 3 is a perspective view of the exemplary clip mechanism of FIG. 2 with the first and second clip portions pivoted into engagement and the first and second securing mechanism portions of the interlocking clip securing mechanism engaged in a manner to lock the first and second clip portions into a substantially fixed relationship.

FIG. 3 shows clip mechanism 30 with first and second clip portions 32, 34 pivoted into engagement and first and second securing mechanism portions 43, 54 of interlocking clip securing mechanism 44 engaged with the rectangular cross section protrusion of second securing mechanism portion 54 deformably inserted within securing aperture 46 of first securing mechanism portion 43.

Figure 4:
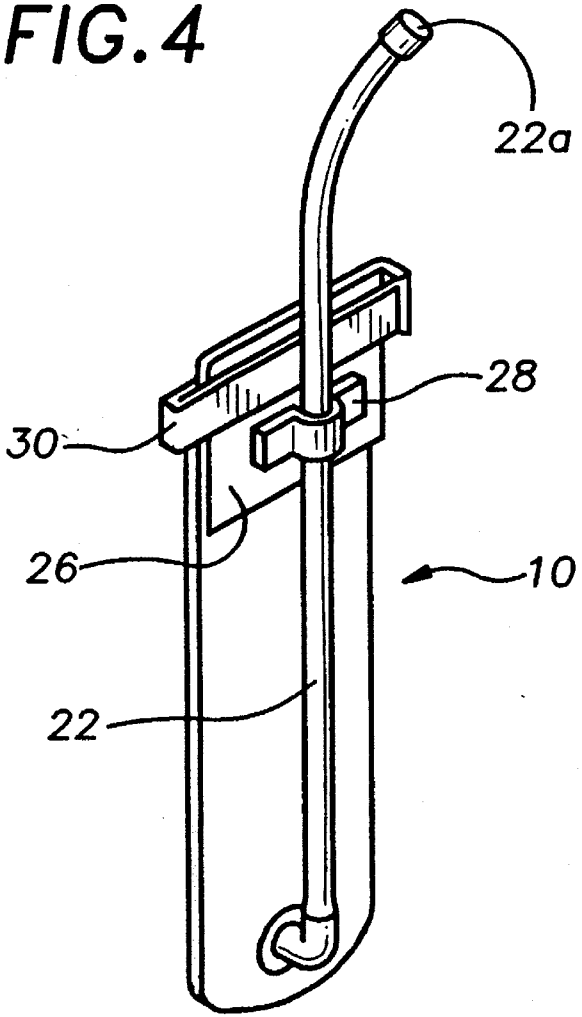
FIG. 4 is a perspective view of the flexible, inner pouch of FIG. 1 with the sealing flap folded over the access opening, the draw tube securing tab secured around a section of the draw tube, and the clip mechanism of FIG. 2 secured about the inner pouch in a manner to provide a liquid tight seal between the access opening and the bottom cavity portion.

FIG. 4 shows inner pouch 10 with sealing flap 26 folded over access opening 14 (FIG. 1), draw tube securing tab 28 secured around a section of draw tube 22, and clip mechanism 30 secured about inner pouch 10 in the manner previously described to provide a liquid tight seal between access opening 14 (FIG. 1) and bottom cavity portion 18 (FIG. 1).

Figure 5:
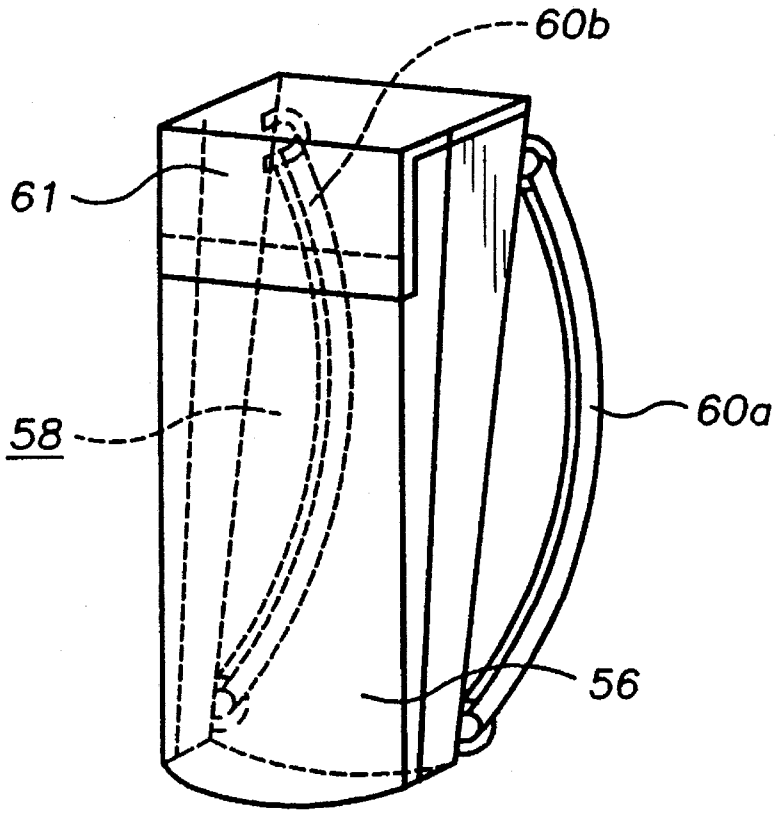
FIG. 5 is a perspective view of an exemplary insulated outer carrying bag having a sealable compartment into which the sealed flexible, inner pouch of FIG. 4 is disposed during use.

In use, inner pouch 10, when thus configured, is placed into an insulated outer carrying bag 56 as shown in FIG. 5. Outer carrying bag 56 is constructed from thermally insulating materials and has a sealable compartment 58 into which sealed, inner pouch 10 is disposed. Access to sealable compartment 58 is through an compartment opening sealable with a sealing flap 61. In this embodiment, carrying bag 56 includes a pair of over-the-shoulder, carrying straps 60*a*,60*b*.

Use of the insulated beverage pouch system is now described with general reference to FIGS. 1–5. To prepare the beverage pouch system for use, beverage cavity 12 of inner pouch 10 is filled via access opening 14 with a desired beverage such as water. Ice cubes or other cooling items may be inserted into beverage cavity 12 via access opening 12 if additional temperature maintenance measures are desired. Clip mechanism 30 is then secured about inner pouch 10 in the manner previously described and draw tube 22 secured with draw tube securing tab 28. Inner pouch 10 is then placed within sealable compartment 58 of insulated outer carrying bag 56 and transported or stored as desired. When it is desired to consume a portion of the beverage contained within beverage cavity 12, draw tube 22 is retrieved from sealable compartment 58 and the beverage consumed. If desired, a draw tube cap 22*a* may be fit over the end of draw tube 22 to seal draw tube 22 during non-drinking periods.

It can be seen from the preceding description that an insulated beverage pouch system has been provided that includes an inner beverage container and an outer insulated carrying bag into which the inner beverage container is placed; and that includes a beverage container having a mouth opening of sufficient size to allow simultaneous insertion therethrough of multiple ice cubes.

It is noted that the embodiment of the insulated beverage pouch system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An insulated beverage pouch system comprising:

an insulated outer carrying bag having a pouch compartment formed therein that is accessible through a sealable compartment access flap, said carrying bag having at least one strap member positionable over said shoulder of a user in a manner to allow the user to carry said carrying bag in a hands free manner;

a flexible, inner beverage pouch of a size sufficient to allow said inner beverage pouch to be completely disposed within said pouch compartment with said compartment access flap sealed, said inner beverage pouch having a beverage cavity formed therein, an access opening into said beverage cavity at one end thereof, a bottom cavity portion formed at an opposite end thereof, and a draw tube having a first end in fluid communication with said bottom cavity portion of said beverage cavity; and a clip mechanism having a first and second pivotally connected clip portion, said first clip portion having two, first-clamping ridges oriented in parallel that extend upwardly from a planar surface thereof, a first end pivotally attached to said second clip portion, and a second end having a first securing mechanism portion of an interlocking clip securing mechanism attached thereto, said second clip portion having three, second-clamping ridges oriented in parallel to each other that extend upwardly from a planar surface thereof, a first end of said second clip portion pivotally attached to said first end of said first clip portion, and a second end of said second clip portion having a second securing mechanism portion of said interlocking clip securing mechanism attached thereto, said first-clamping ridges being spaced and located on said first clip portion and said second-clamping ridges being spaced and located on said second clip portion in a manner such that when said first and second clip portions are pivoted in a first direction, said two first-clamping ridges have a second-clamping ridge disposed therebetween and said first and second securing mechanism portions of said interlocking clip securing mechanism are securable together to lock said first and second clip portions in a substantially fixed position with respect to each other, a section of said inner pouch between said bottom cavity portion and said access opening being positionable between said first and second clip portions in a manner to provide a liquid tight barrier between said bottom cavity portion and said access opening when said first and second clip portions are locked in the substantially fixed position with respect to each other with said interlocking clip securing mechanism.

2. The insulated beverage pouch system of claim 1, further including:

a cap member having a draw tube end receing cavity sized to receive therein a free end of said draw tube in a manner to seal fluid outflow through said draw tube.

3. The insulated beverage pouch system of claim 1, wherein:

said inner pouch is constructed from a section of resilient, flexible plastic sheeting material that has been secured together along an outer perimeter thereof to form said beverage cavity.

4. The insulated beverage pouch system of claim 1, wherein:

said inner pouch further includes a sealing flap and a draw tube is releasably securable about said draw tube in a manner to secure a securing tab, said draw tube securing tab having one free end that section of said draw tube against said inner pouch.

5. The insulated beverage pouch system of claim 1 wherein:

one of said first and second securing mechanism portions being pivotally attached to one of said clip portions, said one securing mechanism portion further and includes a securing aperture formed therethrough; and the other of said securing mechanism portions having a resiliently deformable protrusion being ettached to and extending from the other of said clip portions and having dimensions selected to allow said other securing mechanism portion to be deformably inserted into and frictionally retained within said securing aperture.

6. The insulated beverage pouch system of claim 2, wherein:

said inner pouch is constructed from a section of resilient, flexible plastic sheeting material that has been secured together along an outer perimeter thereof to form said beverage cavity.

7. The insulated beverage pouch system of claim 2, wherein:

said inner pouch further includes a sealing flap and a draw tube securing tab, said draw tube securing tab having one free end that is releasably securable about said draw tube in a manner to secure a section of said draw tube against said inner pouch.

8. The insulated beverage pouch system of claim 2 wherein:

one of said first and second securing mechanism portions being pivotally attached to one of said clip portions, said one securing mechanism portion further and includes a securing aperture formed therethrough; and the other of said securing mechanism portions having a resiliently deformable protrusion being attached to and extending from the other of said clip portions and having dimensions selected to allow said other securing mechanism portion to be deformably inserted into and frictionally retained within said securing aperture.

9. The insulated beverage pouch system of claim 6, wherein:

said inner pouch further includes a sealing flap and a draw tube securing tab, said draw tube securing tab having one free end that is releasably securable about said draw tube in a manner to secure a section of said draw tube against said inner pouch.

10. The insulated beverage pouch system of claim 9 wherein:

one of said first and second securing mechanism portions being pivotally attached to one of said clip portions, said one securing mechanism portion further and includes a securing aperture formed therethrough; and the other of said securing mechanism portions having a resiliently deformable protrusion being attached to and from the other of said clip portions and having dimensions selected to allow said other securing mechanism portion to be deformably inserted into and frictionally retained within said securing aperture.

11. The insulated beverage pouch system of claim 7 wherein:

one of said first and second securing mechanism portions being pivotally attached to one of said clip portions, said one securing mechanism portion further and includes a securing aperture formed therethrough; and the other of said securing mechanism portions having a resiliently deformable protrusion being attached to and extending from the other of said clip portions and having dimensions selected to allow said other securing mechanism portion to be deformably inserted into and frictionally retained within said securing aperture.

12. The insulated beverage pouch system of claim 3, wherein:

said inner pouch further includes a sealing flap and a draw tube securing tab, said draw tube securing tab having one free end that is releasably securable about said draw tube in a manner to secure a section of said draw tube against said inner pouch.

13. The insulated beverage pouch system of claim 12 wherein:

one of said first and second securing mechanism portion being pivotally attached to one of said clip portions, said one securing mechanism portion further and includes a securing aperture formed therethrough; and the other of said securing mechanism portions having a resiliently deformable protrusion being attached to and extending from the other of said cilp portions and having dimensions selected to allow said other securing mechanism portion to be deformably inserted into and frictionally retained within said securing aperture.

14. The insulated beverage pouch system of claim 3 wherein:

one of said first and second securing mechanism portions being pivotally attached to one of said clip portions, said one securing mechanism portion further and includes a securing aperture formed therethrough; and the other of said securing mechanism portions having a resiliently deformable protrusion being attached to and extending from the other of said clip portions and having dimensions selected to allow said other securing mechanism portion to be deformably inserted into and frictionally retained within said securing aperture.

15. The insulated beverage pouch system of claim 4 wherein:

one of said first and second securing mechanism portions being pivotally attached to one of said clip portions, said one securing mechanism portion further and includes a securing aperture formed therethrough; and the other of said securing mechanism portions having a resiliently deformable protrusion being attached to and extending from the other of said clip portions and having dimensions selected to allow said other securing mechanism portion to be deformably inserted into and frictionally retained within said securing aperture.

* * * * *